US005122174A

United States Patent [19]

Sunder et al.

[11] Patent Number: 5,122,174

[45] Date of Patent: Jun. 16, 1992

[54] BOILING PROCESS AND A HEAT EXCHANGER FOR USE IN THE PROCESS

[75] Inventors: Swaminathan Sunder; Douglas L. Bennett, both of Allentown; Donn M. Herron, Fogelsville; Keith A. Ludwig, Emmaus; Edwin C. Rogusky, Catasauqua, all of Pa.

[73] Assignee: Air Products and Chemicals, Inc., Allentown, Pa.

[21] Appl. No.: 663,339

[22] Filed: Mar. 1, 1991

[51] Int. Cl.[5] ..... F25J 3/02

[52] U.S. Cl. ..... 62/24; 62/36; 62/42; 165/166

[58] Field of Search ..... 62/36, 42, 11, 24; 165/166

[56] References Cited

U.S. PATENT DOCUMENTS

| | | | |
|---|---|---|---|
| Re. 33,026 | 8/1989 | Petit et al. | 62/36 |
| 3,282,334 | 11/1966 | Stahlheber | 62/36 |
| 3,568,462 | 3/1971 | Hoffman et al. | 62/42 |
| 3,992,168 | 11/1976 | Toyama et al. | 62/42 |
| 4,574,007 | 3/1986 | Yearout et al. | 62/42 |
| 4,599,097 | 7/1986 | Petit et al. | 165/166 |
| 4,606,745 | 8/1986 | Fujita | 165/166 |
| 4,646,822 | 5/1987 | Voggenreiter et al. | 165/166 |
| 4,699,209 | 10/1987 | Thorogood | 165/166 |
| 4,715,431 | 12/1987 | Schwartz | 62/36 |
| 4,715,433 | 12/1987 | Schwartz | 62/36 |

FOREIGN PATENT DOCUMENTS

| | | |
|---|---|---|
| 28509 | 5/1971 | Australia . |
| 0303492 | 2/1989 | European Pat. Off. . |

*Primary Examiner*—Ronald C. Capossela

*Attorney, Agent, or Firm*—Willard Jones, II; William F. Marsh; James C. Simmons

[57] ABSTRACT

The present invention relates to a boiling process in a downflow heat exchanger and the heat exchanger itself with liquid distribution enhancing features which improve performance and allow safe and efficient operation. Performance enhancing features include a partially flooded hardway distribution region with a liquid volume fraction greater than about 0.25 and preferably greater than 0.5, adjusting the heat transfer surface area to maintain a liquid film Reynolds number above 20 and, preferably, above 50 yet less than 1000, preferably less than 300, for at least 75% of the reboiler surface, and, optionally, intermediate feeding of liquid at various intervals along the length of the heat exchanger to obtain more uniform values of liquid film Reynolds numbers and intermediate redistribution.

17 Claims, 5 Drawing Sheets

BOILING PROCESS AND A HEAT EXCHANGER FOR USE IN THE PROCESS

TECHNICAL FIELD

The present invention is related to a downflow reboiler (heat exchanger) for use in processes for the cryogenic distillation of gas mixtures, in particular, air, to separate such into their constituent components. The present invention also relates to a boiling process using such downflow reboiler.

BACKGROUND OF THE INVENTION

Reboilers in thermally linked columns of air separation plants are generally of the thermosiphon type. In many cases, the fluids exchanging heat are relatively pure nitrogen on the high temperature side and pure or impure oxygen on the low temperature side. The nitrogen condenses in downflow and serves as the reflux for the high pressure column, while the oxygen boils in upflow and serves as the boil-up for the low pressure column. The pressure in the high pressure column drives the flow of the nitrogen through the condensing side of the heat exchanger and the condensed nitrogen is then allowed to build static head equivalent to the pressure drop for it to flow back into the high pressure column. The flow on the oxygen side on the other hand is driven by the density difference between the outside of the exchanger, which is essentially all liquid, and the inside of the exchanger, which is part vapor and part liquid. The heat exchanger is usually completely or partially submerged in the oxygen it boils. The resulting cooling curves are not parallel and this feature limits the approach temperatures of the two streams. For a given pressure in the low pressure column, this increases the pressure at which the high pressure column has to operate, and thereby the power consumption of the main air compressor. Any innovation that allows the two stream temperatures to approach more closely in a parallel fashion would be beneficial in terms of the overall thermodynamic efficiency of the plant. It should be pointed out that although the above problem has been described in terms of the main reboiler/condenser of an air separation column the nonparallel cooling curves can occur in other reboiler/condensers in an air separation plant or any thermosiphons used in the heat exchanger industry. There would be potential improvements in thermodynamic efficiencies in all such situations by rendering the cooling curves parallel by some engineering modification.

The drive towards more energy efficient air separation plants, especially of large size, has produced many advances in the traditional areas such as the distillation columns, compressors, pumps and expanders. Heat exchangers, specifically the reboiler/condensers, are also a potential area for significant gains. Just as the falling film evaporators commonly used in the food industry have demonstrated, the advantages of downflow boiling can also be of value to the cryogenic air separation industry. Several patents make references to this concept and the following discussion will highlight their key features and the shortcomings that the current invention disclosure attempts to remedy.

EP 0 303 492 A2 discloses a method of enhancing heat transfer coefficients for boiling by spraying the surface with a thermally conductive coating consisting of metallic and plastic particles. The reference cites experimental results that show the advantages of the sprayed surface over the unsprayed surface in pool boiling and of the sprayed surface over both of the above when boiling is in downflow. The reference makes specific references to reboiler/condensers used in air separation columns wherein the boiling is in downflow. The boiling liquid distribution is via a single stage intra-passage distribution using orifices from the top. The reference teaches that a typical exchanger has a spacing of about 100 mm with 6 mm high fins and 2.5 mm fin gap.

U.S. Pat. No. Re 33,026 teaches a downflow heat exchanger which incorporates predistribution of a boiling liquid for reboil, e.g. liquid oxygen, by holes and fine distribution by means of a packing to form a continuous running liquid film. This principle is particularly applicable to air separation plants. While predistribution is accomplished by means of orifices, fine distribution can be achieved by means of serrated hardway finning or by means of a sprayed liquid on the primary surfaces or the parting sheets. Enhancement to distribution by horizontal ribbing is mentioned.

Australian Pat. No. 28509/71 teaches a reboiler/condenser incorporating two stage or one stage distribution with restrictions, namely through orifices, that cause flashing to form vapor from the boiling liquid feed in order to get a two-phase mixture in the distribution zone.

U.S. Pat. No. 3,992,168 teaches an exchanger which is a condenser and rectifier in one core. The core taught by this patent has provisions for splitting the vapor and liquid phases in the boiling stream, such that the vapor feeds directly from the header into the finning while the liquid has to pass through perforations before it rejoins the vapor. This backup upstream of these perforations is the coarse distribution analogous to the predistribution in U.S. Pat. No. Re 33,026. Another feature mentioned in the patent is decreasing fin density along the boiling side to reduce the pressure drop thereby accommodating the increasing vapor content.

U.S. Pat No. 4,646,822 discloses a mixing device that is used to distribute two-phase mixtures uniformly into the passages of a heat exchanger. The mixing device can be applied to both the hot and cold streams when they each consist of two phases. The approach is to introduce one phase, preferably the vapor, at one end of the core from a header into each passage and the other phase, preferably the liquid, from a header via slots with and without orifices into each passage where the latter phase mixes with the former. The pressure drop in the fins downstream of the mixing device is stated to ensure that the fluid is distributed uniformly. Several embodiments are shown which are different in mechanical detail but not in the purpose. The hot and cold streams are shown to be flowing in countercurrent fashion. The orientation of the core is not stated clearly to ascertain if the boiling occurs in upflow or downflow.

This patent is relevant only when it is viewed in the restricted case of downflow boiling wherein the phase distributed through the header via slots is the liquid phase.

A shortcoming that is common to all the above references is that they attempt to distribute the boiling fluid only at the inlet to the core but do not provide any means to correct a boiling liquid's natural tendency to maldistribute and form dry patches as it evaporates in downflow. It is well known that dry patches are detrimental to heat transfer and good wetting of all the boiling surfaces has to be maintained especially for near complete evaporation.

SUMMARY OF THE INVENTION

The present invention is an improvement to a process for vaporizing a liquid by heat exchange with a second fluid in a heat exchanger designed to maintain no more than a small temperature difference between the liquid and the second fluid. The heat exchanger used in the process comprises a parallelpipedal body formed by an assembly of parallel vertical extending passages having generally vertical corrugated fins therein. The liquid is introduced into a first group of passages and the second fluid is introduced into a second group of passages constituting the remaining passages. The liquid is distributed at the top of and throughout the horizontal length of the first group of passages. The improvement which enhances performance of the process comprises three steps. In the first step, a fixed volume distribution zone is established and maintained above the vertical corrugated fins in the first group of passages. This distribution zone contains hardway finning. In the second step, the liquid is passed downwardly and over the hardway finning at a rate such that at least twenty five percent (25%) of the available volume of said distribution zone is in the liquid phase. In the third and final step, the liquid is passed downwardly over the generally vertical corrugated fins in the first group of passages as a thin film and controlling the liquid flow at a rate to maintain a local liquid film Reynolds number of at least 20 but not greater than 1OOO throughout the upper seventy five percent (75%) of the generally vertical corrugated fins.

The present invention is also an improvement to a heat exchanger comprising means for vaporizing a liquid by heat exchange with a second fluid while maintaining no more than a small temperature difference between the liquid and the second fluid. The exchanger includes a parallelpipedal body comprising an assembly of parallel plates having walls defining therebetween a multitude of flat, vertical passages having generally vertical corrugated fins therein. The flat passages comprise a first group of passages and a second group of passages constituting the remainder of the passages. The exchanger includes means for distributing the liquid at the top of and throughout the horizontal length of the first group of passages. The improvement for enhancing performance of the heat exchanger comprises two means. The first means is a means for providing an essentially uniform film of liquid onto the generally vertical corrugated fins in the first group of passages. The second means is means for enhancing wetting of at least the top seventy five percent (75%) of the generally vertical corrugated fins in the first group of passages.

The improved boiling process and heat exchanger is particularly useful in an air separation process. In such a process, the boiling process would be used to at least partially vaporize a liquid oxygen-enriched stream by means of heat exchange against a nitrogen rich fluid stream.

DETAILED DESCRIPTION OF THE INVENTION

Boiling liquids in a downflow manner has many economic and technical advantages over the conventional thermosiphon manner, yet can be unstable leading to the formation of dry patches which are detrimental to heat transfer. This detriment is especially true as one tries to boil the boiling side fluid completely. It is, therefore, necessary to obtain good liquid distribution on the heat transfer surface and to minimize the liquid film's tendency to form rivulets along the length of the exchanger.

The present invention is a downflow boiling heat exchanger including features which result in a design which can take full advantage of the benefits of downflow boiling in increasing the efficiency of plants such as those used for separating air into its constituents while overcoming the detriments known in the art. The main features of the heat exchanger of present invention are a means for providing an essentially uniform film of liquid onto the heat transfer surface (fins) in the boiling passages of the heat exchanger and the means for enhancing wetting of at least the top seventy five percent (75%) of the heat transfer surface in the boiling passages of the heat exchanger. The present invention is also a boiling process. The key mechanical and process features of the current invention which achieve the above objectives are best described with reference to several specific embodiments. Although the present invention has more general applicability, for the ease of discussion of these embodiments, the boiling and condensing fluids will be typically referred to as oxygen and nitrogen, respectively.

EMBODIMENT 1

Figure 1:
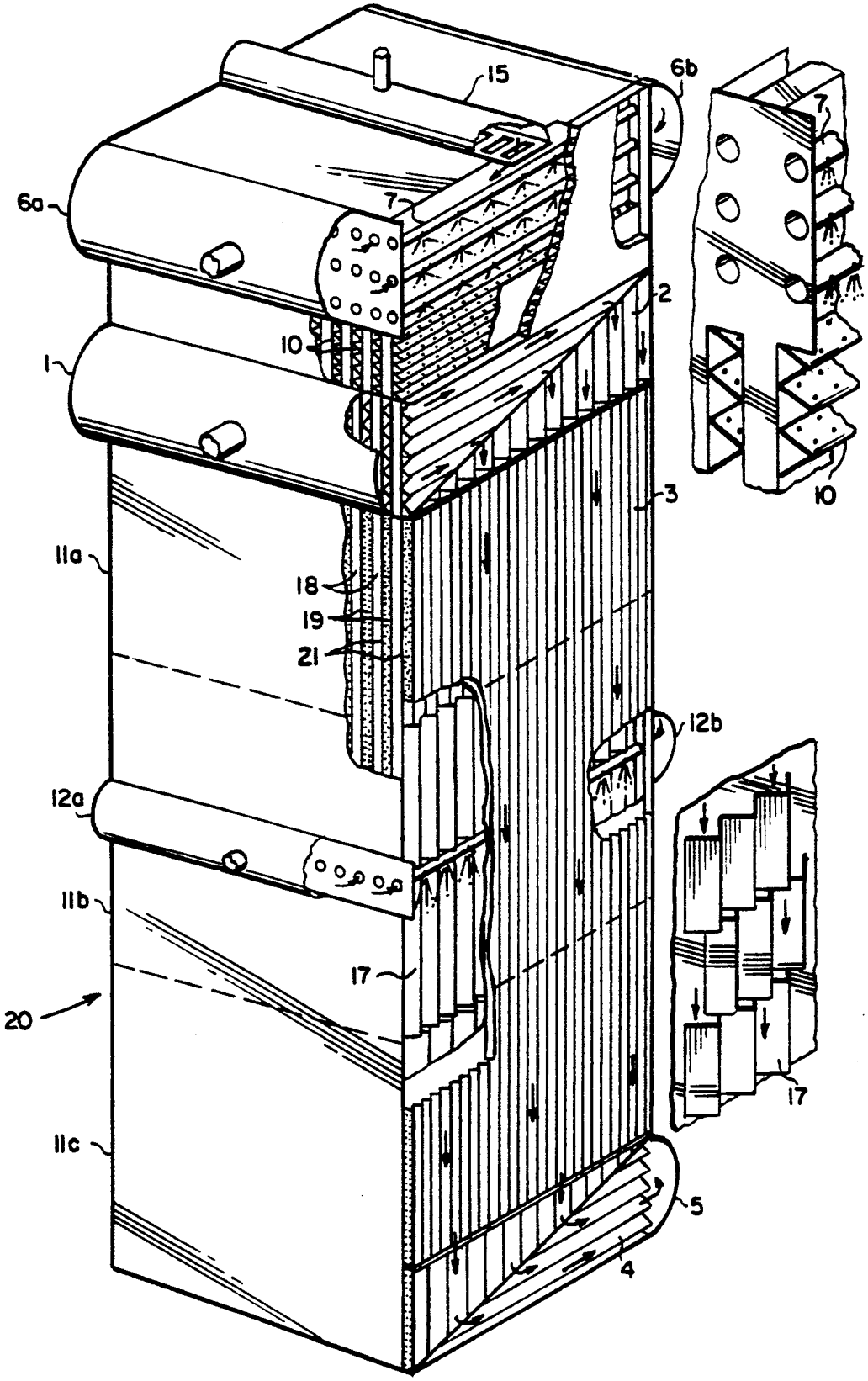
FIG. 1 is an isometric drawing of the preferred embodiment of the heat exchanger of the present invention.

FIG. 1 shows an isometric illustration of the first embodiment of the heat exchanger of the present invention. With reference to FIG. 1, the present invention comprises means (exchanger) 20 for vaporizing a liquid by heat exchange with a second fluid. Exchanger 20 is essentially a parallelpipedal body comprising an assembly of parallel plates 21 having walls defining therebetween a multitude of flat, vertical passages having generally vertical corrugated fins 17. These passages comprise a first group of passages 18 and a second group of passages 19.

Exchanger 20 includes means for distributing the liquid at the top of and throughout the horizontal length of the first group of passages 18. These means for distributing the liquid at the top of and throughout the horizontal length of the first group of passages 18 comprises a plurality of perforated, liquid injection tubes 7 located along the horizontal length of the first group of passages 18, wherein such perforation are of an effective orientation, size, and location so as to essentially evenly distribute the liquid. Liquid is fed to liquid injection tubes 7 by means of headers 6*a* and 6*b*.

Exchanger 20 further includes means 10 for providing an essentially uniform film of liquid onto the generally vertical corrugated fins 17 in the first group of passages 18. Means 10 is preferably a hardway finning. These hardway finning 10 are designed to have an effective resistance to flow in the vertical direction to allow for flow in the horizontal direction so as during operation of the exchanger the liquid film on the hardway finning occupies at least twenty five percent (25%), preferably fifty percent (50%) of the void space of the hardway finning. To accomplish this liquid retention, the preferred hardway finning is a perforated corrugated finning.

An enlarged fragmentized view of the upper corner of exchanger 20 has been provided in FIG. 1 to illustrate injection tubes 7 and means 10 in more detail.

The generally vertical corrugated fins 17 of the first group of passages 18 are preferably serrated easyway finning. This serrated easyway finning is shown in the lower enlarged fragmentized view of FIG. 1.

Exchanger 20 includes means for enhancing wetting of at least the top seventy five percent (75%) of the generally vertical corrugated fins 17 in the first group of passages 18. Preferably, the means for enhancing wetting of at least the top seventy five percent (75%) of the generally vertical corrugated fins 17 in the first group of passages 18 comprises one or both of the following. First, a plurality of successive generally vertical corrugated fin sections 11*a*, 11*b* and 11*c* of decreasing surface area are designed to have an effective surface area so that during operation of the heat exchanger a Reynolds number of at least 20, preferably 50, but not more than 1000, preferably 300, is maintained for the liquid film in each section. The local liquid film Reynolds number is defined as follows:

$$Re_L = \frac{4\Gamma}{\mu}$$

where:

$\Gamma$ = the liquid mass flowrate at a given elevation divided by the perimeter available for wetting $\mu$ = the dynamic viscosity of the liquid Second, means 13 for introducing additional liquid at a vertical intermediate location of first group of passages 18 throughout the horizontal length of said passages. Liquid is fed to said means 13 through headers 12*a* and 12*b*. The location for means 13 for introducing additional liquid is selected to establish a more uniform film thickness throughout the heat transfer length for better performance.

Exchanger 20 further includes means 15 which can be used to introduce additional liquid or vapor to the top of first group of passages 18.

Figure 2B:
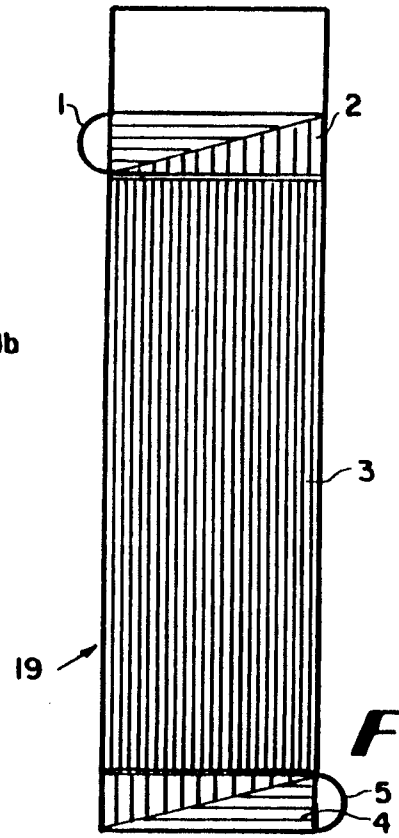
FIG. 2*b* is a schematic of the second fluid passage of the heat exchanger shown in FIG. 1.
Figure 2A:
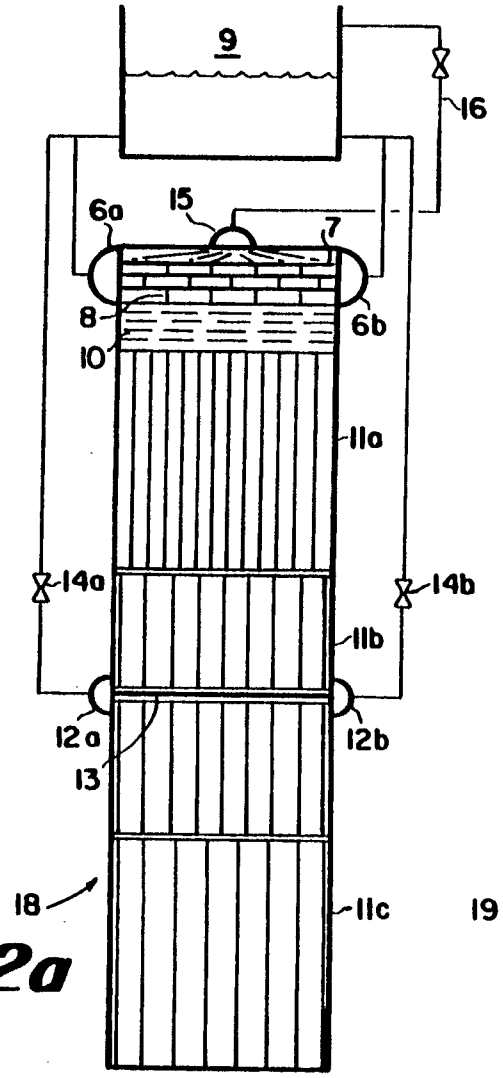
FIG. 2*a* is a schematic of the liquid passage of the heat exchanger shown in FIG. 1.

Exchanger 20, particularly, the operation of a process using exchanger 20 can be further explained using the schematic diagrams of FIGS. 2*a* and 2*b*. FIGS. 2*a* and 2*b* illustrate representative oxygen (18) and nitrogen (19) passage in the heat exchanger core.

With reference to FIG. 2, nitrogen vapor is fed via header 1 into inlet distributor fins 2 from where it flows along heat transfer fins 3 before leaving the exchanger via the outlet distributor fins 4 and the header 5. Heat transfer fins 3 are comprised generally vertical corrugated fins; these fins can be perforated or serrated.

Liquid oxygen is fed via headers 6*a* and 6*b* into injection tubes 7, which are positioned between support fins 8. The injection tubes have perforations which spray the oxygen into the passages. The resistance to flow by the injection tubes will force the liquid oxygen to back up into a head tank 9 and assure uniform passage-to-passage distribution of the oxygen. This is accomplished by the proper selection of the number of the injection tubes, their inner diameters, and the orientation, diameter, pitch and location of the holes in the injection tubes.

Oxygen that is fed via these holes then falls on a finning 10 that is oriented in the "hardway" direction; hardway means where the direction of the finning is perpendicular to the flow of the fluid. The resistance to flow in the hardway finning will force the oxygen to spread across the width of each individual passage. The selection of the hardway finning is such that under normal operating conditions it is at least 25% or, preferably, at least 50% full of liquid. Such hardway finning can be of the perforated or serrated type with the former being preferred for its mechanical simplicity.

It should be noted that the above mentioned two regions are adiabatic, that is they do not begin to exchange heat against the nitrogen until further below against the nitrogen inlet distributor fins 2.

Oxygen that is well distributed then flows over the heat transfer sections 11*a*, 11*b* and 11*c* (each of which can consist of multiple fin pads) largely in film-wise flow and begins to boil. As the rate of evaporation is sensitive to the film thickness, additional means of introducing liquid oxygen is provided via the mid injection headers 12*a* and 12*b* and tube 13. Thus, liquid oxygen from fins 11*a* and injection tube 13 combine and flow over fins 11*b*. The ratio of the oxygen fed to the top and mid injection tubes 7 and 13 is controlled by valves 14*a* and 14*b*. In the limiting case, all the flow can be fed via the top tube alone when obtaining uniform thickness is not critical. As a further means of enhancing wetting of the oxygen passages the heat transfer fins in successive pads of 11*a* and 11*b* are so selected that there is less surface to be wetted as more and more boiling has taken place. This can be achieved by using less and less dense finning as one moves from the top to the bottom, i.e., reducing the heat transfer surface area to maintain a liquid local film Reynolds number above 20 and, preferably, above 50 yet not more than 1OOO, preferably 300, for at least 75% of the reboiler surface. The liquid film Reynolds number should be typically below 250. This method works well to satisfy the simultaneous need to increase the flow area to accommodate progressively increasing vapor flow but should be balanced against the need for maximizing the surface area for heat transfer.

EMBODIMENT 2

Figure 3:
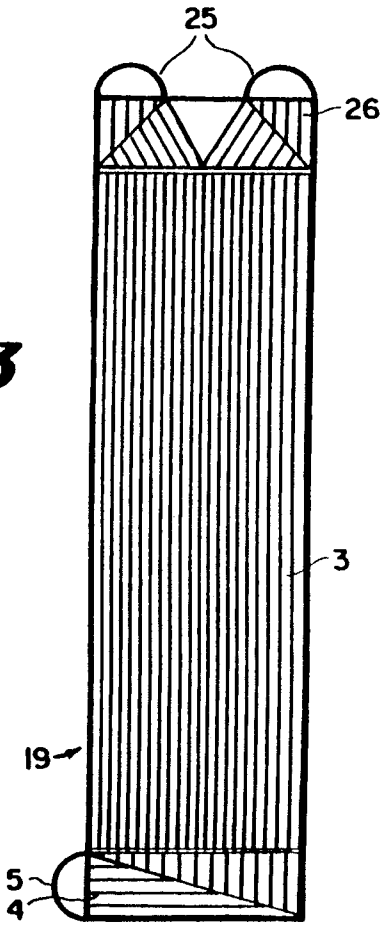
FIG. 3 is a schematic of an alternate embodiment of the second fluid passage of the present invention.

FIG. 3 shows a variation of the nitrogen passage 19 of the embodiment shown in FIG. 2*b*. In this embodiment nitrogen inlet distributors 25 and 26 are located at the top of exchanger 20 such that the sections of oxygen passage 18 containing injection tubes 7 and hardway finning 10 (FIG. 2*a*) are not adiabatic, i.e, heat exchange takes place. The additional heat exchange should be utilized when a controlled vaporization of the saturated liquid feed to hardway finning 10 is beneficial for intra passage liquid distribution or when the feed to hardway finning 10 is a subcooled liquid.

EMBODIMENTS 3 & 4

In a variation of Embodiments 1 & 2, the middle injection tubes 13 are eliminated to simplify the mechanical construction and lower the cost of the exchanger. Clearly, this would apply to situations where such secondary means of liquid distribution are not important.

EMBODIMENT 5

In a variation of Embodiments 1 to 4, oxygen vapor external to the exchanger is added in controlled fashion via port 15 (FIG. 2*a*) in order to improve liquid distribution inside the passages.

EMBODIMENT 6

In a variation of Embodiments 1 to 4, oxygen vapor generated inside the exchanger is allowed to escape from the top of the exchanger via port 15 as well as the bottom of the exchanger in order to minimize the pressure drop in oxygen passage 18.

EMBODIMENT 7

In a variation of Embodiments 1 to 4 and in reference to FIG. 2*a*, oxygen liquid from the head tank 9 is allowed to overflow into the oxygen passages directly via port 15 bypassing the headers 6*a* and 6*b* and injection tubes 7. This bypass occurs only when the liquid oxygen reaches a level high enough to overflow via line 16.

EMBODIMENT 8

Figure 4:
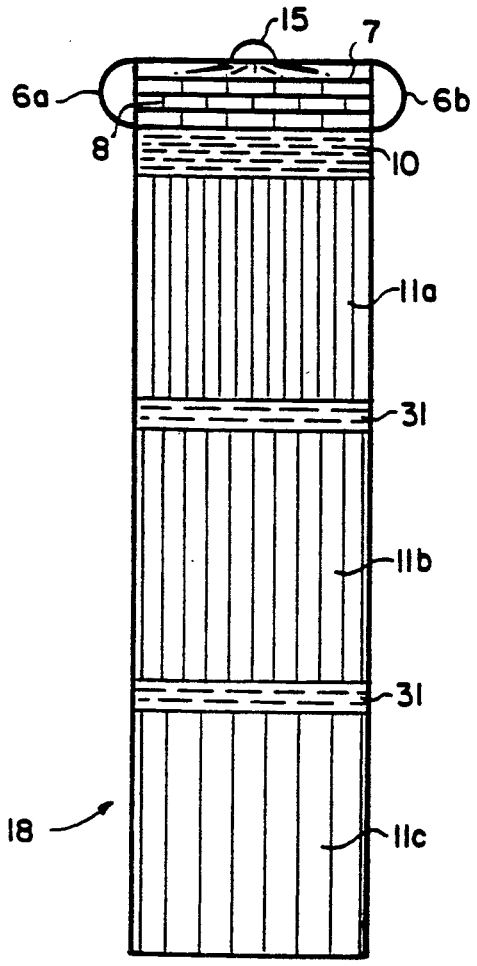
FIG. 4 is a schematic of an alternate embodiment of the liquid passage of the present invention.

In a variation of Embodiments 1 to 5 and in reference to FIG. 4, the liquid oxygen is redistributed along the exchanger by one or more devices 31 which respread it uniformly across the width. The vapor flows through redistributors 31. These redistributors are partial obstructions oriented perpendicular to the flow. The pressure drop per redistributor is in the range of 0.005 to 0.2 psi and preferably in the range of 0.01 to 0.05 psi. Examples would include appropriately selected hardway fins.

The above eight embodiments are particularly useful for a variety of air separation processes. The application of these embodiments is very broad. In essence, the process (and heat exchanger) of the present invention can be used in any air separation process utilizing a cryogenic distillation column system having at least one column wherein a liquid oxygen-enriched stream is partially condensed by heat exchange against a nitrogen-rich fluid. For clarity of definition, the term "rich" when used to modify a component (i.e., nitrogen-rich) means that the named component is the major (>50%) component in the subject stream, and the term "enriched" when used to modify a component (i.e., oxygen-enriched) means that the named component has a concentration in the subject stream greater than its concentration in air (e.g., oxygen-enriched means an oxygen concentration greater than ~21 vol %).

Figure 5:
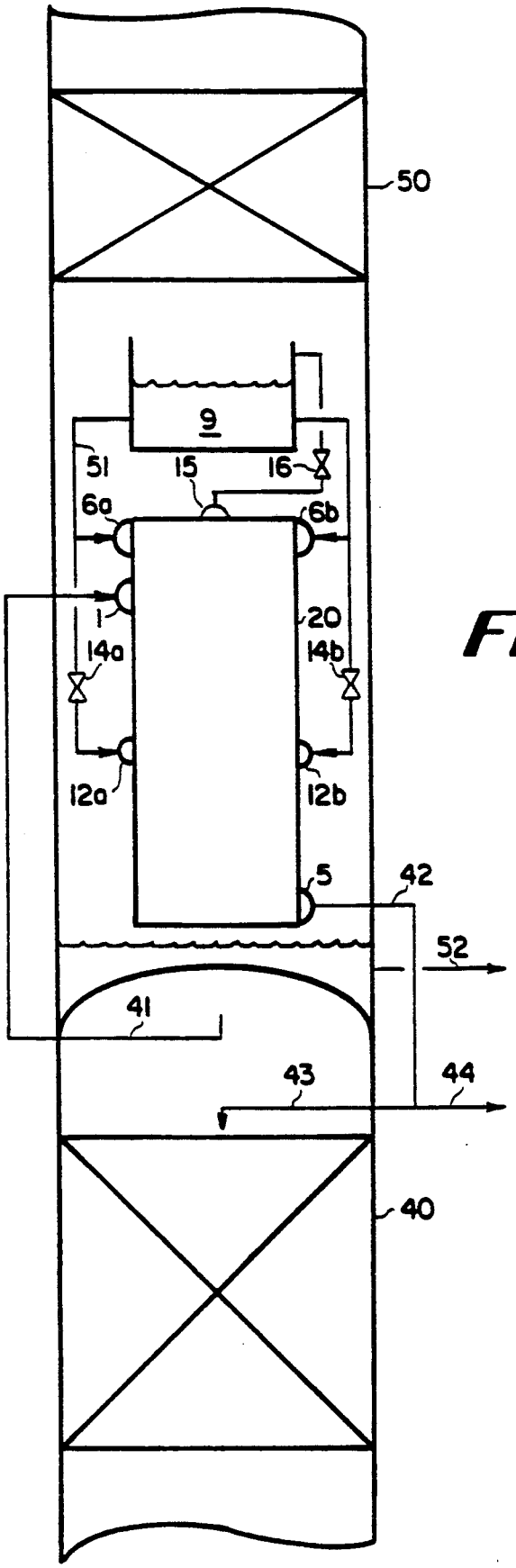
FIGS. 5 and 6 are schematic diagrams of the incorporation of the present invention into an air separation process.

The use of these embodiments can be better described by discussing an air separation process primarily producing a gaseous oxygen product, which uses a cryogenic distillation system comprising at least two columns operating at different pressures, where the two columns are thermally integrated. FIG. 5 presents a schematic diagram of the section of such an air separation process where the present invention would be used. With reference to FIG. 5, compressed and cooled feed air is rectified in high pressure column 40 (only a portion of the column is shown) producing HP nitrogen overhead and a crude liquid oxygen bottoms. The HP nitrogen overhead is removed from column 40 via line 41 and fed to reboiler/condenser 20 located in the bottom of low pressure column 50 via header 1. In reboiler/condenser 20 the HP nitrogen overhead is condensed by heat exchange with boiling liquid oxygen from column 40. The condensed nitrogen is removed via header 5 into line 42 and then split into two portions. A first portion, in line 43, which is returned to column 40, for reflux. A second portion, in line 44, which can be removed from the process as liquid nitrogen product.

The liquid oxygen to be boiled in reboiler/condenser 20 is collected from the bottom tray of column 40 in heat tank 9. Liquid oxygen is removed from head tank 9 via line 51 and fed to headers 6*a* and 6*b* and, optionally, headers 12*a* and 12*b*. If used, flow to headers 12*a* and 12*b* would be controlled by valves 14*a* and 14*b*. In reboiler/condenser 20, the bulk of the liquid oxygen boils and the gaseous oxygen and any unvaporized liquid oxygen is removed from the bottom. The gaseous oxygen rises up the column to provide vapor boil-up and the unboiled liquid is collected in a sump at the bottom of column 40. This liquid oxygen can be removed as a purge or product stream via line 52.

Figure 6:
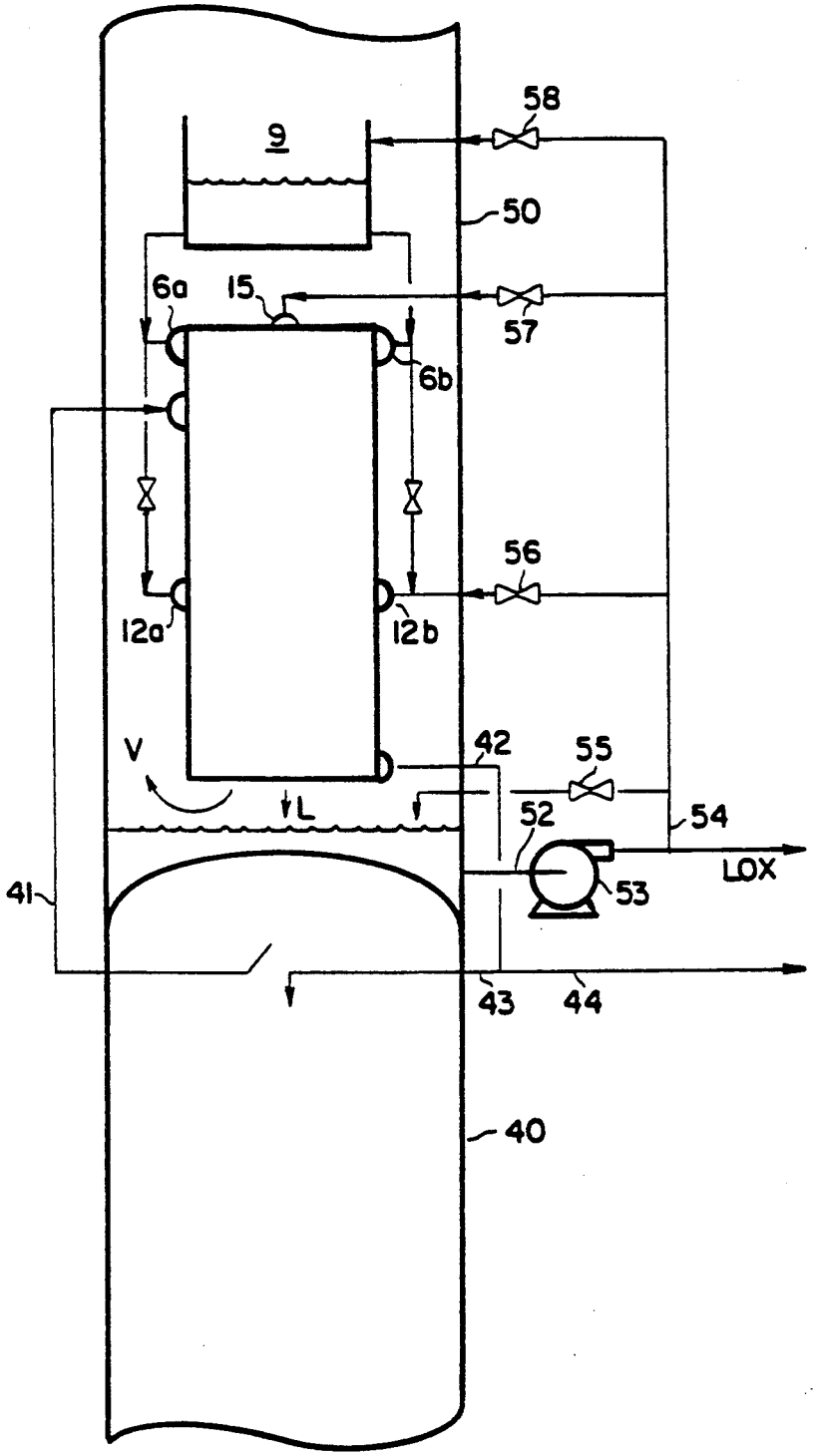

The above discussion describes a way liquid and vapor oxygen can be distributed into the exchanger in an air separation plant that produces primarily gaseous oxygen rather than liquid oxygen. However, with air separation plants that produce liquid oxygen or that nevertheless use a pumped liquid oxygen cycle the availability of the pump gives rise to the possibility of recycling some of the unevaporated liquid oxygen back to the head tank. This gives rise to an additional way as depicted in FIG. 6. Part of the liquid oxygen that exits the heat exchanger core can be recycled by the pump 53 via any or all of valves 55, 56, 57 and 58 in order to achieve best wetting and heat transfer performance.

The current invention allows the boiling and condensing streams in heat exchangers such as those used in air separation plants to achieve temperature approach in a nearer to parallel and therefore more close fashion than in conventional thermosiphons by boiling the lower temperature stream in downflow. This closer temperature approach reduces the power consumption of the plant. The invention also describes mechanical and process features that allow the adjustment of the boiling stream flow to optimize the performance of the heat exchanger. It works by distributing and maintaining the boiling fluid in uniform film-flow over all the heat transfer sections of the exchanger. Liquid oxygen from head tanks is fed uniformly to all the boiling passages by using the controlling resistance of injection tubes. Once inside the passage, completely or partially flooded hardway fins are used to distribute the liquid oxygen across the width of each passage. As the descending film in the heat transfer section gradually becomes thinner when it boils, the fin density is progressively reduced such that under design conditions no part of any fin is under a critical liquid film Reynolds number. To account for film breakdown under fouled, unsteady or otherwise nondesign operating conditions several provisions are made to adjust the flow during operation and restore good wetting. These include vapor introduction at the top, and introduction of liquid oxygen feed at different points along the length of the core. The invention also allows removal of gaseous oxygen from the top of the core to decrease the pressure drop or minimize the power consumption. Also, Embodiment 2 allows the controlled generation of vapor in the hardway fin section by exchange against the condensing nitrogen for enhanced intra-passage distribution. Further, Embodiment 8 uses frequent liquid redistributors along the length of the heat exchanger.

The present invention has been described with reference to several specific embodiments thereof. These embodiments should not be considered to be a limitation on the scope of the present invention. The scope of the present invention should be ascertained from the following claims.

We claim:

1. In a process for vaporizing a liquid by heat exchange with a second fluid by means of a heat exchanger designed to maintain no more than a small temperature difference between the liquid and the second fluid, wherein the heat exchanger comprises a parallelpipedal body formed by an assembly of parallel vertical extending passages having generally vertical corrugated fins therein, wherein the liquid is introduced into a first group of passages and the second fluid is introduced into a second group of passages constituting the remaining passages, and wherein the liquid is distributed at the top of and throughout the horizontal length of the first group of passages, the improvement for enhanced performance which comprises:

(a) establishing and maintaining a fixed volume distribution zone containing hardway finning disposed above the vertical corrugated fins in the first group of passages;

(b) passing the liquid downwardly and over the hardway finning at a rate such that at least twenty five percent (25%) of the available volume of said distribution zone is in the liquid phase; and (c) passing the liquid downwardly over the generally vertical corrugated fins in the first group of passages as a thin film and controlling the liquid flow at a rate to maintain a local liquid film Reynolds number of at least 20 but not greater than 1OOO throughout the upper seventy five percent (75%) of the generally vertical corrugated fins.

2. The process of claim 1 wherein the liquid flow rate is controlled to maintain the local Reynolds number by passing the liquid over the generally vertical corrugated fins in the first group of passages wherein the generally vertical corrugated fins comprises a plurality of successive generally vertical corrugated fin sections of decreasing surface area.

3. The process of claim 1 which further comprises introducing the liquid by means of a plurality of perforated, liquid injection tubes located along the horizontal length of the top of the passages of the first group of passages, wherein such perforation are of an effective orientation, size, and location so as to essentially evenly distribute the liquid along the horizontal length of the passages of the first group of passages;

4. The process of claim 1 which further comprises introducing an effective quantity of additional liquid throughout the horizontal length of the passages of the first group of passages at an intermediate location along the vertical length of the passages thereby preventing the liquid film from becoming non-uniform.

5. The process of claim 1 which further comprises introducing additional liquid to the top of the passages of the first group of passages.

6. The process of claim 1 wherein the liquid is passed downwardly over the hardway finning at a rate such that at least fifty percent (50%) of the available volume of said distribution zone is in the liquid phase.

7. The process of claim 1 which further comprises redistributing the liquid in at least one location along the vertical length of the passages of the first group of passages by means of a redistributor in each passage comprising a partial obstruction oriented perpendicular to the flow of the liquid having a pressure drop per redistributor in the range of 0.005 to 0.2 psi.

8. The process of claim 7 wherein the redistributor comprises hardway finning.

9. The process of claim 1 wherein heat is transferred from the second fluid to the liquid in the distribution zone.

10. The process of claim 1 which further comprises introducing vapor into the top of the first passages to further facilitate distribution of the liquid.

11. The process of claim 1 wherein the range of the local liquid film Reynolds number is between 50 and 300.

12. In a process for the separation of air into its constituent components, wherein the separation is carried out in a cryogenic distillation column system comprising at least one distillation column, wherein a nitrogen-rich fluid stream is heat exchanged against an oxygen-enriched liquid stream thereby at least partially vaporizing the oxygen-enriched liquid stream by means of a heat exchanger designed to maintain no more than a small temperature difference between the oxygen-enriched liquid stream and the nitrogen-rich fluid stream, wherein the heat exchanger comprises a parallelpipedal body formed by an assembly of parallel vertical extending passages having generally vertical corrugated fins therein, wherein the oxygen-enriched liquid stream is introduced into a first group of passages and the nitrogen-rich fluid stream is introduced into a second group of passages constituting the remaining passages, and wherein the oxygen-enriched liquid stream is distributed at the top of and throughout the horizontal length of the first group of passages, the improvement for enhanced performance comprises:

(a) establishing and maintaining a fixed volume distribution zone containing hardway finning disposed above the vertical corrugated fins in the first group of passages;

(b) passing the oxygen-enriched liquid stream downwardly and over the hardway finning at a rate such that at least twenty five percent (25%) of the available volume of said distribution zone is in the liquid phase; and (c) passing the oxygen-enriched liquid stream downwardly over the generally vertical corrugated fins in the first group of passages as a thin film and controlling the oxygen-enriched liquid stream flow at a rate to maintain a local liquid film Reynolds number of at least 20 but not greater than 1000 throughout the upper seventy five percent (75%) of the generally vertical corrugated fins.

13. The process of claim 12 which further comprises collecting any unvaporized oxygen-enriched liquid exiting the bottom of the heat exchanger and recycling at least a portion of the collected liquid back to the heat exchanger for vaporization.

14. The process of claim 13 wherein said portion of the collected liquid is used to provide additional liquid throughout the horizontal length of the passages of the first group of passages at an intermediate location along the vertical length of the passages thereby improving the uniformity of the film thickness throughout the heat transfer surface.

15. The process of claim 12 wherein the separation is carried out in cryogenic distillation column system comprising at least two distillation columns operating at different pressures, wherein air is compressed and cooled to its dew point and fed to the higher pressure column of the two distillation columns for rectification into a first nitrogen overhead and a crude liquid oxygen bottoms, wherein the crude liquid oxygen bottoms is fed to the lower pressure column of the two distillation columns for distillation into a second nitrogen overhead and a second liquid oxygen bottoms, wherein the higher pressure column and the lower pressure column are in thermal communication with each other, and wherein the nitrogen-rich fluid stream is the first nitrogen overhead and the oxygen-enriched liquid stream is the second liquid oxygen bottoms.

16. The process of claim 12 wherein the separation is carried out in a single cryogenic distillation, wherein air is compressed and cooled to its dew point and fed to the distillation column for rectification into a nitrogen overhead and a crude liquid oxygen bottoms, wherein reflux for the distillation column is provided by condensing at least a portion of the nitrogen overhead against the crude liquid oxygen bottoms thereby vaporizing at least a portion of the crude liquid oxygen bottoms in the heat exchanger wherein the nitrogen overhead is the nitrogen-rich fluid stream and the crude liquid oxygen bottoms is the oxygen-enriched liquid stream.

17. The process of claim 12 which further comprises introducing an effective quantity of additional oxygen-enriched liquid throughout the horizontal length of the passages of the first group of passages at an intermediate location along the vertical length of the passages thereby preventing the liquid film from becoming non-uniform.

* * * * *